United States Patent [19]

Cavey et al.

[11] Patent Number: 4,727,606

[45] Date of Patent: Mar. 1, 1988

[54] BATHROOM ACCESSORY

[76] Inventors: Suzanne E. Cavey, 830 Glastonbury Rd. #505, Nashville, Tenn. 37217-7401; George Spector, 233 Broadway RM 3615, New York, N.Y. 10007

[21] Appl. No.: 839,631

[22] Filed: Mar. 14, 1986

[51] Int. Cl.[4] ..... A47K 3/22

[52] U.S. Cl. ..... 4/611; 4/605; 4/574; 4/559; D6/525; D6/316; 211/87; 248/309.2

[58] Field of Search ..... 4/546, 559, 597, 605, 4/628, 661, 574, 573, 578, 571, 611; 248/915, 309.1, 309.2; 211/87; D6/525, 316, 569; 312/228, 229; 297/14, 15; 108/48, 38; D11/132-140

[56] References Cited

U.S. PATENT DOCUMENTS

| | | | |
|---|---|---|---|
| D. 56,565 | 11/1920 | Pondelicek | 248/309.1 |
| D. 155,100 | 9/1949 | Millward, Sr. | D6/316 |
| D. 156,563 | 12/1949 | Sallee | D6/316 |
| 661,351 | 11/1900 | Manning | 4/597 |
| 1,732,777 | 10/1929 | Simmons, Sr. | 211/87 |
| 2,965,153 | 12/1960 | Purcell, Sr. | 4/578 |
| 4,087,127 | 5/1978 | Lotta | 4/578 |
| 4,228,552 | 10/1980 | Weaver, Jr. | 4/546 |
| 4,457,031 | 7/1984 | Moore | 4/605 |

*Primary Examiner*—Henry J. Recla
*Assistant Examiner*—Linda J. Sholl

[57] ABSTRACT

A bathroom accessory for installation on a wall within a shower/bathtub is provided and consists of an elongated waterproof sheet that has an embossed picture of a person in a bathing suit thereon and a plurality of holders on the sheet for carrying toilet articles used in bathing.

2 Claims, 5 Drawing Figures

BATHROOM ACCESSORY

BACKGROUND OF THE INVENTION

The instant invention relates generally to bathing appliances and more specifically it relates to a bathroom accessory for installation on a wall within a shower/-bathtub.

Numerous bathing appliances have been provided in prior art that are adapted to aid persons when in the shower by holding soap and the like. For example, U.S. Pat. Nos. 1,416,270; 3,373,448 and 4,398,309 all are illustrative of such prior art. While these units may be suitable for the particular purpose to which they address, they would not be as suitable for the purposes of the present invention as heretofore described.

SUMMARY OF THE INVENTION

A principle object of the present invention is to provide a bathroom accessory that will overcome the shortcomings of the prior art devices.

Another object is to provide a bathroom accessory that is a sheet installed on a wall with a shower/bathtub so as to hold soap, shampoo and a wash cloth, etc.

An additional object is to provide a bathroom accessory that includes an embossed picture of a person on the sheet which can have adjustable arms and legs to perform various tasks during bathing within the shower/bathtub.

A further object is to provide a bathroom accessory that is simple and easy to use.

A still further object is to provide a bathroom accessory that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
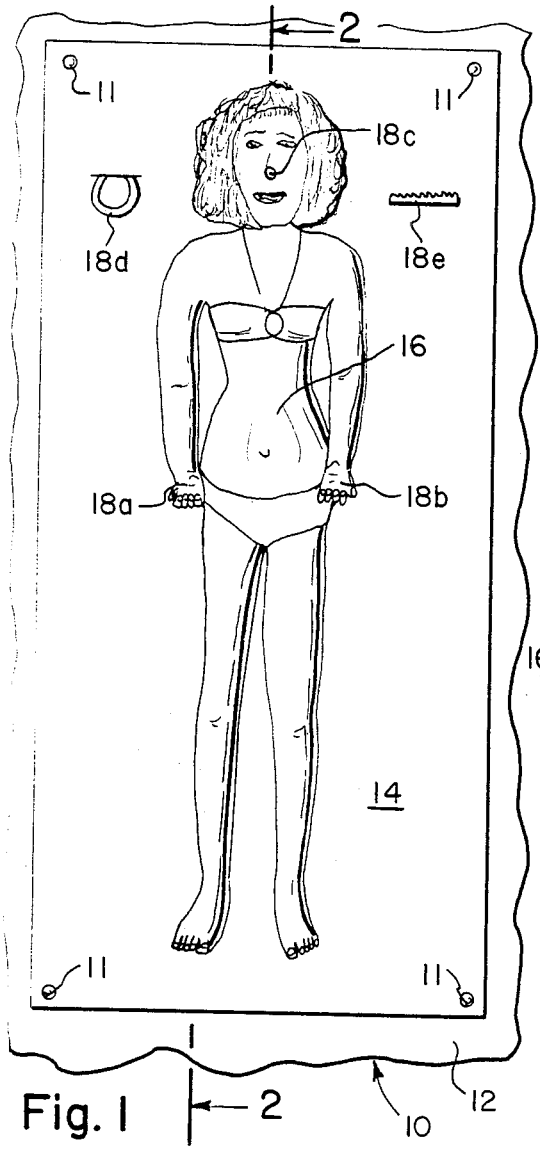
FIG. 1 is a front elevational view of the invention mounted to a shower wall.
Figure 2:
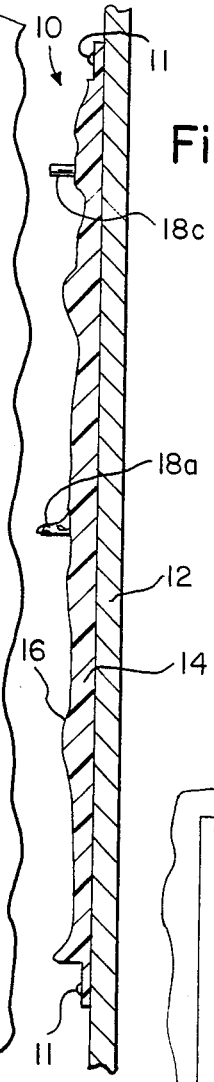
FIG. 2 is a cross sectional taken along line 2—2 in FIG. 2.

Turning now descriptively to the drawings, in which similar reference characters denote similar elements throughout the several views, FIGS. 1 and 2 illustrate a bathroom accessory 10 for installation by fasteners 11 on a wall 12 in a shower/bathtub. The bathroom accessory 10 consists of an elongated waterproof sheet 14 that has an embossed picture 16 of a female or male person in a bathing suit thereon and a plurality of holders 18*a* to 18*d* on the sheet 14 for carrying toilet articles used in bathing.

Holders 18*a* and 18*b* are for soap and are formed by upturned hands in the embossed picture 16 of the person on the sheet 14. Holder 18*c* is a rod extending from nose of the embossed picture 16, and can hold a wash cloth. Holder 18*d* is a ring for holding a wash cloth and is attached to the sheet 14 on one side of head of the embossed picture 16. Holder 18*e* is a tray for holding soap and shampoo and is attached to the sheet 14 on other side of the head of the embossed picture 16. Holders 18*d* and 18*e* are attached to the side of the head of embossed picture 16 by conventional means such as screws, adhesive or the like.

Figure 4:
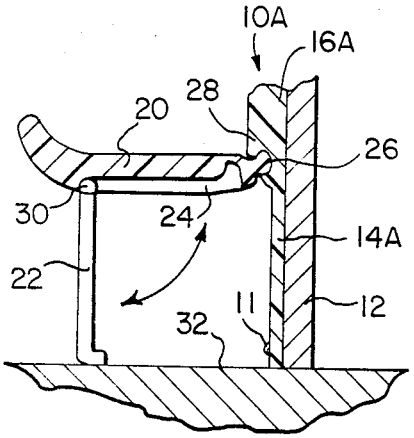
FIG. 4 is a cross sectional view taken along line 4—4 in FIG. 3 showing an adjustable leg for supporting the user's foot or body in a sitting or stooping position.
Figure 3:
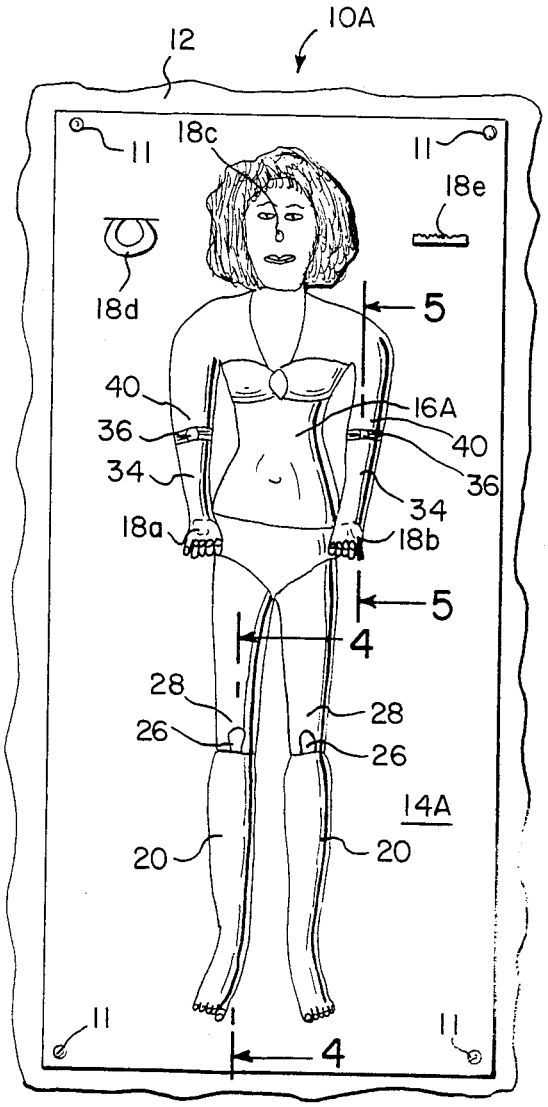
FIG. 3 is a front elevational view of a modification of the invention mounted to a shower wall.

In referring to FIGS. 3 and 4 a modified bathroom accessory 10A is shown consisting of a pair of doll legs 20 and a pair of support legs 22. Each doll leg 20 has a rear recess 24 therein and a ball socket 26 pivotly connected to knee 28 of the embossed picture 16A of the person on the sheet 14A. Each support leg 22 is pivotly connected at 30 to lower portion of the recess 24.

When each of the doll legs 20 is pulled upwards each of the support legs 22 can pivot downwards to make contact with shower/bathtub floor 32 for supporting a bather's foot/body in a sitting/stooping position.

Figure 5:
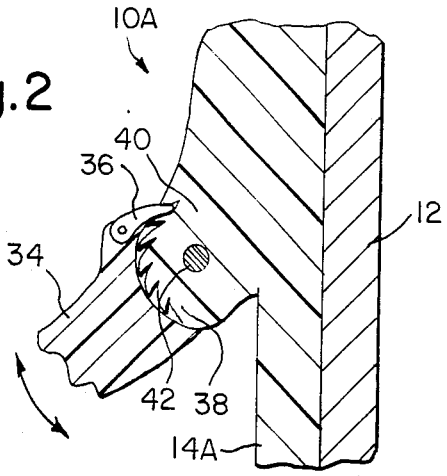
FIG. 5 is a cross sectional view taken along line 5—5 in FIG. 3 showing an adjustable arm.

In referring to FIGS. 3 and 5 the modified bathroom accessory 10A further contains a pair of doll arms 34. Each doll arm has a pawl 36 and ratchet 38 at an elbow joint 40 which is pivotly connected at 42 to the embossed picture 16A of the person on the sheet 14A. Each of the doll arms 34 can be moved and held in various elevated positions to perform various tasks in bathing, such as holding bathing articles wherein the combined weight of the bathing article and arm 34 is insufficient to displace pawl 36 from the ratchet notches. Displacement of pawl 36 from the ratchet notches can only be effected by a sufficient predetermined manual effort.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A bathroom accessory for installation on a wall within a shower which comprises:

(a) an elongated waterproof sheet having an embossed form of a person in a bathing suit thereon;

(b) a plurality of holders on said sheet for carrying toilet articles used in bathing, wherein said holders are in the form of upturned hands extending from terminal ends of arms of said embossed form;

(c) said embossed form further comprising a pair of legs each having a lower portion with a rear recess therein extending the length thereof and an upper portion, a ball socket joint pivotly connecting said lower portion to said upper portion; and (d) a pair of support legs each pivotly connected, respectively, to said lower portions of said pair of legs at a lower point in said recess so that when each of said lower portions of said pair of legs is pulled upwards with respect to said upper portion of said pair of legs, said support legs can pivot downwards to make contact with a shower floor, whereby said lower portions are used for supporting a bather's foot.

2. A bathroom accessory as recited in claim 1, further comprising:

(a) a pair of arms and hands with elbows having means for pivoting each of said arms at the elbows to position said hands at various convenient positions for holding articles used for bathing purposes.

* * * * *